United States Patent [19]

Oman

[11] Patent Number: 4,474,370

[45] Date of Patent: Oct. 2, 1984

[54] THERAPEUTIC WEIGHTLIFTER'S BENCH

[76] Inventor: Kim W. Oman, 1306 Kearney Dr., North Brunswick, N.J. 08902

[21] Appl. No.: 440,960

[22] Filed: Nov. 12, 1982

[51] Int. Cl.[3] ..... A63B 21/00; A63B 13/00

[52] U.S. Cl. ..... 272/144; 128/69; 272/23; 5/446

[58] Field of Search ..... 272/93, 144, 145, 122, 272/123; 128/69, 70; 5/446

[56] References Cited

U.S. PATENT DOCUMENTS

| | | | |
|---|---|---|---|
| 885,243 | 4/1908 | Haas | 272/144 |
| 1,549,601 | 8/1925 | Mulgrew | 128/69 X |
| 1,904,039 | 4/1933 | Bruder | 272/144 |
| 2,048,587 | 7/1936 | Averill | 272/144 |
| 2,264,046 | 11/1941 | McClellan | 272/145 |
| 2,521,530 | 9/1950 | McGuffage | 128/69 |
| 4,205,838 | 6/1980 | McIntosh | 272/123 |

FOREIGN PATENT DOCUMENTS

| | | | |
|---|---|---|---|
| 1241643 | 8/1960 | France | 5/446 |

*Primary Examiner*—Richard J. Johnson
*Attorney, Agent, or Firm*—Arthur L. Plevy

[57] ABSTRACT

A weightlifter's bench comprises a planar platform supported in a horizontal position and having located near one end a cervical support cushion for supporting the cervical area of a user. The other end of the platform contains an adjustable lumbar cushion which can be moved and fixed in position with respect to the cervical support cushion to provide additional support for the lumbar region of the user. Adjustment of the lumbar support cushion is afforded by means coupled to the cushion which enable the cushion to slide with respect to the platform to thereby assume any one of a plurality of positions necessary to accommodate users of different sizes.

15 Claims, 3 Drawing Figures

THERAPEUTIC WEIGHTLIFTER'S BENCH

BACKGROUND OF THE INVENTION

This invention relates in general to exercise devices and in particular to weightlifter's bench of the type enabling a user to perform bench presses.

The prior art is replete with a number of patents and devices which enable individuals to exercise to develop body musculature. In particular a very useful and popular exercise is designated as bench pressing.

In performing such an exercise, a bench is employed which essentially consists of a planar platform which is about 4 feet in length and approximately 12 or more inches in width. The planar platform is supported by legs and has at one end, a barbell support means for supporting a desired bar and weights.

In using the bench, the weightlifer places his head at the end containing the barbell support means and lies on the platform with his legs extending from the end of the platform towards the ground. The user then grasps the barbell and moves it towards his chest and upwards again to exercise and develop the pectoral muscles. Essentially, the weight benches of the prior art may take on various forms, but the one described above is typical of such a bench.

In any event, based on the nature of the bench and the flat surface of the platform, there are many problems which can cause injuries to the cervical and lumbar area of a user. Many weightlifters, in attempting to perform bench presses using conventional benches, tend to arch the lumbar spine area. In doing this, the weightlifter places great pressure on the lumbar area which may result in serious back injury.

The weightlifter also has a tendency to utilize his head as an additional restraint when performing bench presses and hence may also injure the cervical area. It is, therefore, an objective of the present invention to provide a weightlifting bench which will aid the user in his exercise while preventing injuries. The bench according to this invention adds comfort and increases the strength of the user by utilizing and accommodating the lordotic curvical and lumbar curvatures of the user's body. The bench to described prevents the user from arching his lumber region, and hence prevents those types of injuries associated with the prior art structures.

BRIEF DESCRIPTION OF THE PREFERRED EMBODIMENT

A weightlifter's bench of the type adapted to enable a user to perform bench presses, comprising a planar platform supported in the horizontal position by supporting legs and having located near one end a cervical support cushion for supporting the cervical area of a user when lying on said platform and support cushion located on said planar member and movebly adjustable with respect to said cervical support to enable a user to move and adjust said lumbar cushion with respect to said cervical cushion to provide additional support for the lumbar region of said user.

DETAILED DESCRIPTION OF THE FIGURES

Figure 1:
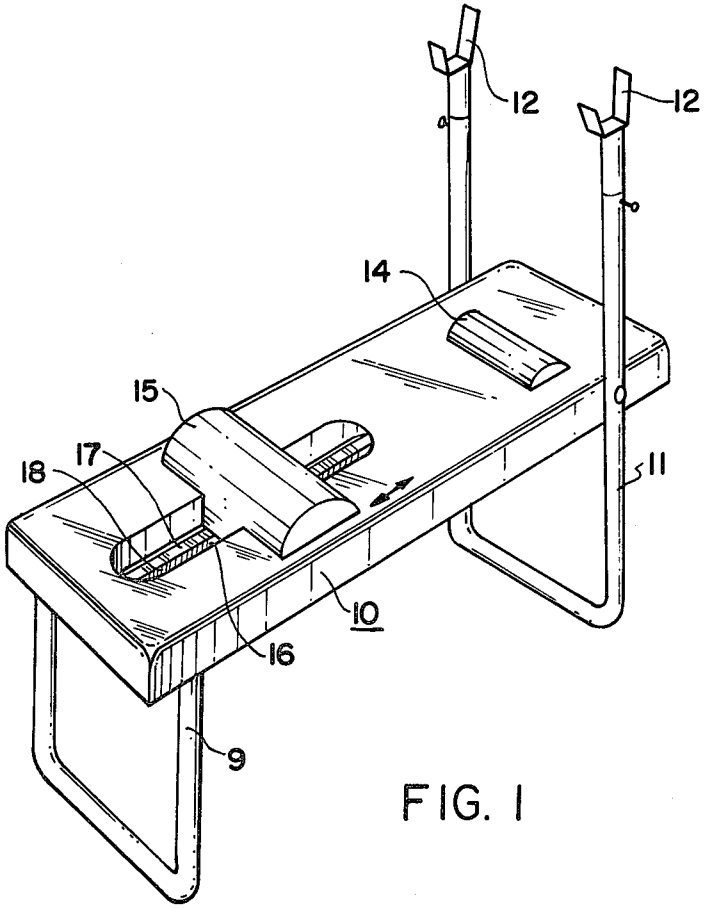
FIG. 1 is a perspective view of a therapeutic weightlifter's bench according to this invention.

Referring to FIG. 1, there is shown an exercise bench 10 which is particularly adapted to enable a user to perform bench presses. Essentially the bench consists of a planar platform 10 which is supported in the horizontal plane by support legs as 11 and 12. The planar member 10 may be padded for comfort and is typically about 4 feet in length and 12 to 14, or more, inches in width. Near the head end of the bench are barbell supporting means as 12 which will enable the user to emplace the bar of a barbell within the accommodating structures. Positioned on the top surface of the planar member is a cervical support cushion 14. Essentially, the cushion 14 has an arcuate or curved top surface which generally conforms to the curve of the cervical area of a user.

The cervical cushion 14 is firmly positioned and secured to the top surface of the bench by conventional means such as suitable fasteners, glues, epoxy and so on. Located on a planar platform 10 is an elongated aperture 16. The aperture 16 is of an ellipsoidal shape but can be of any suitable geometrical shape.

Essentially, the aperture or opening 16 in the platform is approximately 15 inches in length and 6 inches in width. These dimensions, by way of example, can vary. Positioned beneath the aperture and rigidly secured to the underside of platform 10 is an elongated metal bar 17 with an extending slot 18. Positioned in the slot is a lumbar cushion 15. The lumbar cushion 15, as will be explained, has means depending from the underside of the cushion which lie in the slot to enable the cushion to move (in the direction of the arrows) on the surface of the platform 10.

In this manner, a user can adjust the position of the lumbar cushion with respect to the fixed cervical cushion to optimumly select a position which best accommodates the weightlifter according to his size and for accommodating his lumbar region. The lumbar cushion and the cervical cushion both have arcuate surfaces which conform to the surface contours of the typical individual.

As is seen, due to the variation in sizes, the lumbar cushion 15 is moveably adjustable with respect to the cervical support to enable a user to use and adjust the lumbar cushion on the surface of the platform to provide additional support for his lumbar region and according to the size of the user.

Figure 2:
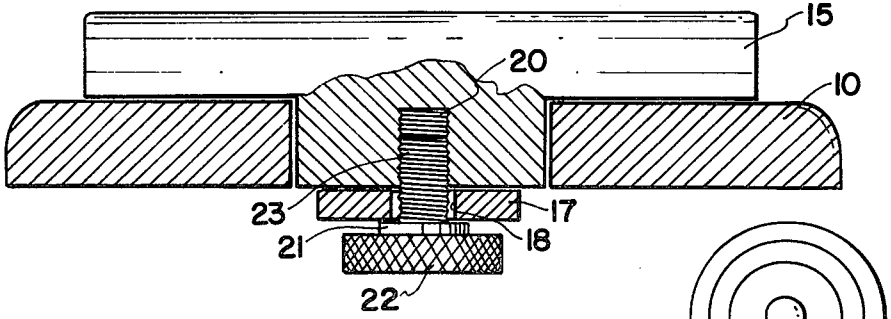
FIG. 2 is a partial cross-sectional view of a lumbar support cushion employing an adjusting mechanism according to this invention.

Referring to FIG. 2, there is shown a partial cross-sectional view of the lumbar cushion 15 and the mechanism utilized to enable the cushion to move as shown in FIG. 1. Essentially, the cushion 15 is of a T-shaped configuration with the base of the T being slightly narrower than the opening 16 in the platform. In this manner, the cushion is prevented from turning or twisting during operation, while further being capable of maintaining a very rigid position.

Contained in the central portion of the cushion is a threaded aperture 20 which extends from the base of the cushion. The hole 20 engages a threaded screw mechanism 23 which is associated with a knob 22 and a locking nut 21 or other suitable mechanism. As can be seen, the screw rides in the slot 18 of the metal bar 17. By rotating or turning the knob 22, one can now tighten or loosen the mechanism to allow the cushion to slide as directed in the slot. Once the user obtains a comfortable position according to his size, he can now fix the cushion in place by tightening the above described mechanism.

Figure 3:
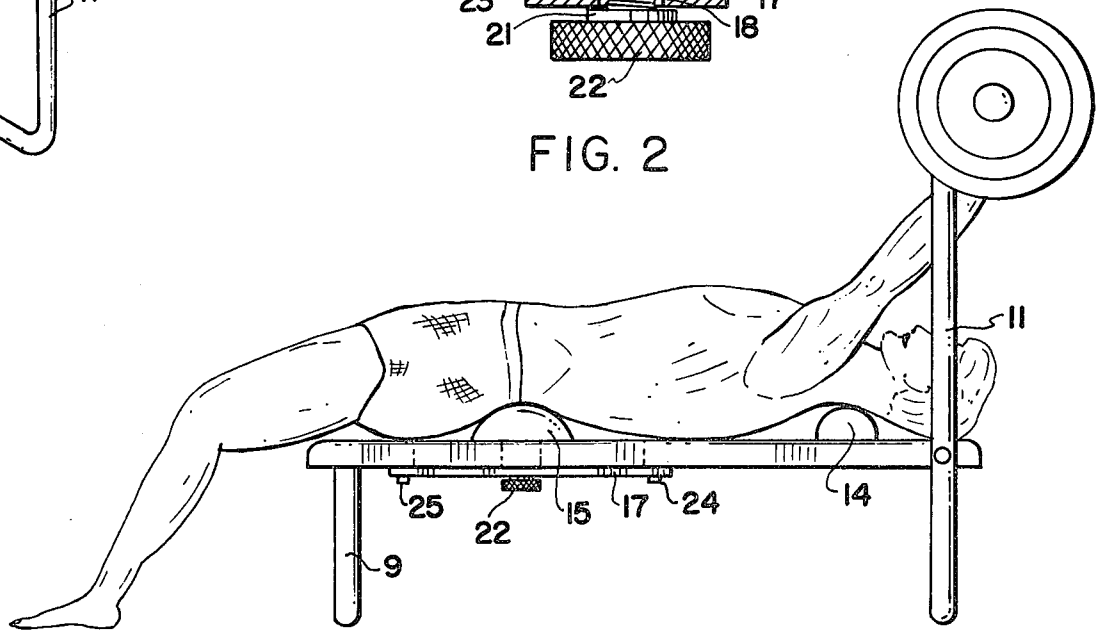
FIG. 3 is a side perspective view of a user employing the weightlifter's bench according to this invention.

Referring to FIG. 3, there is shown an elevational view of a weightlifter employing the above described apparatus. As one can see in FIG. 3, both the cervical and lumbar cushions generally have a smooth arcuate surface as a semi-circular configuration and both are padded with a suitable foam rubber type of material to provide cushioning for the cervical and lumbar areas of the user.

In a typical example the cervical cushion may be approximately 4 inches wide and may extend upwards about 2½ inches. The lumbar cushion is typically 5 inches wide and extends upwards approximately 3 inches. Again, these dimensions are by way of example and have been used with success in a typical embodiment.

It is understood that, based on the above described mechanism, that the lumbar cushion can be removed and replaced with alternate configurations which can be prescribed by a physician to accommodate different lumbar curvatures. In any event, the above described apparatus has great utility in enabling a weightlifter to perform bench pressing and exercise while preventing injuries. The apparatus greatly adds to the comfort of the user and serves to increase the strength of the user because it optimumly utilizes and accommodates the lordotic cervical and lumbar curvatures. In using the mechanism, the conscious arching of the lumbar spine is not required, and the apparatus serves to prevent the weightlifter from doing so thus obviating this potentially dangerous practice.

The above described mechanism is a preferred way of accomplishing the adjustment of the lumbar support with respect to the cervical support, however, there are alternate mechanisms that may be discerned which will accomplish the same results. It is, of course, a main objective of the above described bench to aid the user in exercise and to prevent injuries to the cervical or lumbar regions which are quite common utilizing the prior art devices.

I claim:

1. A weightlifter's bench of the type adapted to enable a user to perform bench presses, comprising;

a planar platform supported in the horizontal position by supporting legs and having located near one end a cervical support cushion for supporting the cervical area of a user when lying on said platform and a lumbar support cushion coupled to said planar platform and moveably adjustable with respect to said cervical support to enable a user to move and firmly position said lumbar cushion on said planar platform with respect to said cervical cushion to provide additional support for the lumbar region of said user, whereby a user can select a desired separation between said cusions and firmly secure said lumbar support cushion in place on said platform to maintain said desired separation.

2. The weightlifter's bench according to claim 1, wherein said platform further includes an elongated aperture extending lengthwise, a support bar positioned lengthwise across said aperture and means coupled to said lumbar support cushion to coact with said slot to allow said lumbar support cushion to move with respect to said cervical support cushion and locking means for securing said lumbar support cushion at any one of a plurality of desired locations with respect to said cervical support cushion.

3. The weightlifter's bench according to claim 2, wherein said means coupled to said lumbar support cushion comprises a threaded aperture, located for positioning over said slot and a threaded screw member for coacting with said aperture to allow said cushion to slide within said slot.

4. The weightlifter's bench according to claim 1, wherein said cervical support cushion has an arcuate top surface of a shape adapted to conform to the cervical curvature of a user.

5. The weightlifter's bench according to claim 1, wherein said lumbar support cushion has an arcuate top surface of a shape adapted to conform to the lumbar curvature of a user.

6. The weightlifter's bench according to claim 2, wherein said lumbar support cushion is of a T-shaped cross section with the base of said "T" of a width slightly less than the width of said aperture to prevent said cushion from turning during use.

7. A weightlifter's bench of the type adapted to enable a user to perform bench presses with therapeutic support for the cervical and lumbar regions of said user, comprising:

a planar platform supported in a horizontal position by support legs and having located near one end a cervical support cushion for supporting the cervical area of a user when lying on the platform, said platform having an elongated aperture on the surface thereof directed near said other end towards said one end, a slotted member secured to said platform and positioned along the length of said aperture, a lumber cushion overlying said aperture and resting on said top surface of said platform with means coupled to said cushion to coact with said slotted member to allow a user to move said cushion along said slotted member to accurately position the same with respect to said cervical support cushion to provide additional lumber support for the lumbar region of said user.

8. The weightlifter's bench according to claim 7, wherein said cervical support cushion has an arcuate top surface with a bottom flat base rigidly secured to said platform.

9. The weightlifter's bench according to claim 7, wherein said lumbar cushion is of a T-shaped cross section with the base of said "T" being less than the width of said aperture.

10. The weightlifter's bench according to claim 9, wherein said horizontal top arm of said "T" has an arcuate top surface for conforming to the lumbar curvature of the a user.

11. The weightlifter's bench according to claim 7, wherein said base of said "T" has a threaded aperture in the bottom surface and positioned over said slot.

12. The weightlifter's bench according to claim 11, further including a threaded member for coacting with said aperture and positioned through said slot with a large diameter head on the end of said member for tightening said member to retain the cushion in a selected position.

13. An exercise bench for use in weightlifting comprising;

a planar platform supported in a relatively horizontal position by support legs, said platform having an elongated aperture near one end and extending toward the other end, an elongated slotted bar positioned lengthwise across said aperture, a "T" shaped lumbar support cushion positioned in said aperture with the sides of the base of said "T" situated adjacent the sides of said aperture with the base of said "T" having a threaded aperture positioned over said slot and a threaded member coacting with said threaded aperture for securing said cushion to said bar to allow said cushion to move with respect to the surface of said platform.

14. The excerise bench according to claim 13, further including a cervical support cushion rigidly secured to said platform near said other end.

15. The exercise bench according to claim 14, wherein said cervical support cushion and said lumbar support cushion have arcuate top surfaces for conforming to the respective curvatures of the body of the user.

* * * * *